US008317229B2

(12) United States Patent
Virostek

(10) Patent No.: US 8,317,229 B2
(45) Date of Patent: Nov. 27, 2012

(54) ADJUSTABLE SKI POLE BASKET

(76) Inventor: Thomas C. Virostek, Gibsonia, PA (US)

( * ) Notice: Subject to any disclaimer, the term of this patent is extended or adjusted under 35 U.S.C. 154(b) by 573 days.

(21) Appl. No.: 12/496,125

(22) Filed: Jul. 1, 2009

(65) Prior Publication Data

US 2010/0001504 A1 Jan. 7, 2010

Related U.S. Application Data

(60) Provisional application No. 61/078,074, filed on Jul. 3, 2008, provisional application No. 61/081,860, filed on Jul. 18, 2008.

(51) Int. Cl.
*A63C 11/24* (2006.01)
*A63C 11/22* (2006.01)

(52) U.S. Cl. ..... 280/824; 280/819

(58) Field of Classification Search ..... 280/809, 280/813, 819, 824
See application file for complete search history.

(56) References Cited

U.S. PATENT DOCUMENTS

| | | | | |
|---|---|---|---|---|
| 1,621,255 | A | 3/1927 | Hunter | |
| 2,123,437 | A | 7/1938 | Ring | |
| 2,346,038 | A | 4/1944 | Mason | |
| 2,492,916 | A | 12/1949 | Chute et al. | |
| 2,596,733 | A | 5/1952 | Sibner | |
| 3,093,402 | A * | 6/1963 | Sisson | 294/100 |
| 3,637,229 | A | 1/1972 | Klemm | |
| 3,645,553 | A | 2/1972 | Hinterholzer | |
| 3,687,472 | A | 8/1972 | Struble, Jr. | |
| 3,797,845 | A | 3/1974 | Kepka et al. | |
| 3,825,275 | A | 7/1974 | Klemm | |
| 3,858,900 | A | 1/1975 | Quinn | |
| 3,933,364 | A | 1/1976 | With | |
| 3,960,382 | A | 6/1976 | Reynolds | |
| 4,014,559 | A | 3/1977 | Funke | |
| 4,091,828 | A | 5/1978 | Jorgensen | |
| 4,214,770 | A | 7/1980 | Agins | |
| 4,319,770 | A | 3/1982 | Drossler | |
| 4,385,776 | A | 5/1983 | Pronzati | |
| 4,669,752 | A | 6/1987 | Jackson et al. | |
| 4,700,975 | A | 10/1987 | Ehemann et al. | |
| 4,811,750 | A * | 3/1989 | McAllister | 135/66 |
| 4,921,275 | A | 5/1990 | Santanen et al. | |
| 5,029,898 | A | 7/1991 | Grignon et al. | |
| 5,150,913 | A | 9/1992 | Hoelzl | |
| 5,236,222 | A * | 8/1993 | Fletcher | 280/809 |
| 5,433,234 | A | 7/1995 | Lapere | |
| 5,636,650 | A | 6/1997 | Kroeze | |
| 5,640,985 | A | 6/1997 | Snyder et al. | |
| 5,755,245 | A | 5/1998 | Van Helvoort | |

(Continued)

FOREIGN PATENT DOCUMENTS

JP 09271556 A 10/1997

*Primary Examiner* — J. Allen Shriver, II
*Assistant Examiner* — Bridget Avery
(74) *Attorney, Agent, or Firm* — The Webb Law Firm

(57) ABSTRACT

The invention relates to an adjustable ski pole basket that can adjust the basket area from a position useful in low-buoyancy-need conditions, such as packed powder, to a position useful in high-buoyancy-need conditions, such as powder. The basket has a fixed based and a movable petal. The petal moves from a compact position useful in low-buoyancy-need conditions to an expanded position useful in high-buoyancy-need conditions, and back. In certain embodiments, the petal is biased toward the expanded position.

19 Claims, 14 Drawing Sheets

U.S. PATENT DOCUMENTS

| | | | | |
|---|---|---|---|---|
| 6,015,165 | A | 1/2000 | Artemis et al. | |
| 6,203,064 | B1 | 3/2001 | Zaltron | |
| 6,386,216 | B1 * | 5/2002 | Cubelli | 135/66 |
| 6,390,109 | B1 | 5/2002 | Manninen | |
| 6,460,891 | B1 | 10/2002 | Jones | |
| 6,755,440 | B1 | 6/2004 | Jones | |
| 7,219,679 | B2 | 5/2007 | Hsu et al. | |
| 7,243,668 | B1 | 7/2007 | Kroeze | |
| 7,252,104 | B1 | 8/2007 | Anderwald | |
| 7,344,320 | B2 | 3/2008 | Barker et al. | |
| 7,377,551 | B2 | 5/2008 | Silverman et al. | |
| 2002/0017596 | A1 | 2/2002 | Spitzer | |
| 2004/0040588 | A1 | 3/2004 | Parigian | |
| 2006/0213545 | A1 | 9/2006 | Hsu et al. | |
| 2006/0266397 | A1 | 11/2006 | Berl | |
| 2008/0011344 | A1 | 1/2008 | Barker | |

* cited by examiner

ADJUSTABLE SKI POLE BASKET

CROSS-REFERENCE TO RELATED APPLICATION

This application claims the benefit of U.S. Provisional Patent Application No. 61/078,074 filed on Jul. 3, 2008, and U.S. Provisional Patent Application No. 61/081,860 filed on Jul. 18, 2008.

BACKGROUND OF THE INVENTION

1. Field of the Invention

The present invention is in the technical field of sporting equipment. More particularly, the present invention is in the technical field of alpine ski equipment and relates to a ski pole having an adjustable basket.

2. Background of the Invention

Conventional ski poles have, at the proximity of the point of contact with the ground (snow), a fixed radius basket, which is usually a horizontal round disk that is perpendicular to the pole, and parallel to the ground, and offers floatation for the ski pole. Floatation is important so that the ski pole does not penetrate more than four or five inches into the snow, thus allowing the skier to rely on the pole for balance, weight-shifting during a directional-change (turn), or for pushing from a standing start. The degree of floatation that a basket offers greatly depends on its radius, thus a larger radius would offer greater floatation.

A drawback of a larger radius basket is that it creates more drag to the skier, both aerodynamically and dragging through the snow (between turns). Historically, the skier has had to commit to a certain fixed-radius basket prior to skiing, since the basket of a traditional ski pole is designed and manufactured in a fixed position with a fixed-radius surface area. Some secondary-market baskets have designed an adjusting feature that might only offer a marginally larger surface area, but could only be adjusted while the skier is standing still, and not instantaneously nor simultaneously.

U.S. Pat. Nos. 6,460,891 and 6,755,440 to Jones disclose a ski pole basket that articulates to accommodate different ski conditions. The snow engaging end of the shaft has an adjustable basket designed to prevent the tip of the ski pole from sinking into soft snow past a predetermined depth. The basket may be adjusted for differing snow conditions to provide greater surface area for engaging softer snow or less surface area to reduce wind resistance for use with hard snow conditions. The basket is created in two parts, an upper basket and a lower basket which is rotatable relative to the upper basket. When it is desirable to have less surface area, the lower basket may be rotated to be aligned with the upper basket. However, for conditions where more surface area is desired, the lower basket may be rotated to any desired position such as approximately 45 degrees so that the extensions of the lower basket can travel and are located within the area existing between the extensions of the upper basket. The rotation of the lower basket relative to the upper basket needs to be manually operated by the skier while the skier is standing still.

There is a need in the art to provide an adjustable ski basket which can be automatically operated while the skier is skiing.

SUMMARY OF THE INVENTION

The present invention has met this need. The invention relates to an adjustable ski pole basket, wherein the adjustable ski pole basket has a petal configured to move from a compact position to an expanded position. In the compact position, the adjustable ski pole basket provides adequate buoyancy for packed-powder/groomed conditions or low-buoyancy-need conditions. In the expanded position, the adjustable ski pole basket provides adequate buoyancy for powder conditions or high-buoyancy-need conditions.

In one embodiment, the invention is a ski pole having a hollow shaft, a ski pole grip coupled to the hollow shaft, and a cone-basket combination attached to the end of the hollow shaft. The cone-basket combination includes a protective cone and a fixed basket affixed to a terminus of the protective cone, wherein the fixed basket has a fixed radius. A petal is housed in the protective cone of the cone-basket combination when the petal is in a compact position and extends through an orifice in the protective cone when the petal is moved to an expanded position. A kinetic rod is positioned within the hollow shaft in communication with the petal and an actuator. Actuation of the actuator moves the kinetic rod towards a tip, wherein the kinetic rod acts on the petal to move the petal to the expanded position.

In one embodiment, the present invention provides a ski pole that includes a hollow shaft, a ski pole grip coupled to the hollow shaft, and a cone-basket combination attached to an end of the hollow shaft. The cone-basket combination includes a protective cone and a fixed basket affixed to a terminus of the protective cone. The fixed basket has a fixed footprint. A petal is housed in the protective cone when in a compact position and extends through an orifice in the protective cone and in an approximately perpendicular direction relative to the hollow shaft when in an expanded position. A kinetic rod is positioned within the hollow shaft and is configured to co-act with the petal to move the petal from a compact position to an expanded position. A biasing member biases the kinetic rod towards a tip-end of the ski pole where the kinetic rod acts on the petal by applying force to the petal thereby moving the petal to the expanded position. When in the expanded position, the petal has a footprint that is greater than the fixed footprint of the fixed basket. Preferably, the ski pole includes an actuator positioned on and extending through the ski pole grip. The actuator co-acts with a stop capsule positioned above the kinetic rod. In the compact position, the stop capsule is positioned against a ledge. Force applied to the actuator releases the stop capsule from the ledge, thereby allowing the biasing member to move the kinetic rod and the petal to the expanded position. The grip includes a removable cap and a pull rod connected to the stop capsule and/or kinetic rod. Removal of the removable cap raises and brings the stop capsule into contact with the ledge, and moves the petal to the compact position.

In another embodiment, the invention is an adjustable ski pole basket having a central stationary member, a petal connected to the central stationary member configured to move between a compact position and an expanded position, and an actuator in communication with the petal configured to move the petal from the compact position to the expanded position upon actuation.

In another embodiment, the invention provides a ski pole that includes an adjustable ski pole basket configured to fit around the ski pole. The adjustable basket includes a central stationary member having an aperture extending therethrough configured to accept the ski pole. A petal is pivotally connected to the central stationary member by a connecting member. The petal is biased to rotate about a pivot point on the central stationary member from a compact position to an expanded position. The connecting member extends through at least a portion of the central stationary member and at least a portion of the petal. The adjustable basket further includes a biasing member for biasing the petal to the expanded position. The biasing member is associated with the connecting member. The petal includes a catch extending from an interior surface of the petal. A latch hub is slidably engaged to the ski pole. The latch hub is positioned on a handle side of the ski pole relative to the central stationary member. It is biased toward a first position or upward position relative to the central stationary member. The latch hub includes a resilient latch positioned on the latch hub and configured to accept the catch when the petal is in the compact position and the latch hub is in the first position.

In another embodiment, the invention is an adjustable ski pole basket. The adjustable ski pole basket includes a central stationary member and a petal pivotally connected to a first side or top of the central stationary member by a connecting member. The petal is biased to rotate about a pivot point on the central stationary member from a compact position to an expanded position. The connecting member extends through at least a portion of the central stationary member and at least a portion of the petal. The adjustable ski pole basket further includes a biasing member for biasing the petal to an expanded position, wherein the biasing member is associated with the connecting member. The petal includes a catch extending from an interior surface of the petal. The adjustable ski pole basket further includes a latch hub associated with the first side portion of the central stationary member and biased toward a first position or upward position relative to the central stationary member. A resilient latch is positioned on the latch hub and is configured to accept the catch when the petal is in the compact position and the latch hub is in the first position.

In another embodiment, the invention is a method of retrofitting a ski pole with an adjustable ski pole basket. The method includes providing a ski pole including an elongated member and a ring member at an end portion thereof. The adjustable ski pole basket described above is attached to the ring member on the ski pole.

In another embodiment, the invention is a method of retrofitting a ski pole with an adjustable ski pole basket. The method includes providing a ski pole including an elongated member. An embodiment of the adjustable ski pole basket described above is attached to an end portion of the ski pole.

In another embodiment, the invention is a method of converting a basket for groomed conditions to a basket for powder conditions. The method includes moving a petal from a compact position to an expanded position. The petal is rotated about a pivot point from a compact position to an expanded position. The petal includes a catch, which extends from the petal. The catch is released from a resilient latch positioned above the adjustable ski pole basket. The petal is then rotated about the pivot point to an extended position. In another embodiment, the petal is connected to a basket coupler. The basket coupler is connected to a kinetic rod. The kinetic rod is in communication with an actuator and a removable cap, wherein actuation of the actuator causes the kinetic rod to move towards a tip-end of the ski pole thereby moving the petal to the expanded position, and removing the removable cap causes the kinetic rod to move toward a handle-side end of the ski pole thereby moving the petal to the compact position.

In another embodiment, the invention is a method of converting a basket for groomed conditions to a basket for powder conditions. The method includes moving a petal from a compact position to an expanded position. The petal is slid through an orifice in a protective cone from a compact position to an expanded position. The petal is in communication with a kinetic rod positioned within a hollow shaft of a ski pole. Movement of the kinetic rod to a first position or upward position moves the petal to the compact position. Movement of the kinetic rod to a second position or downward position moves the petal to the expanded position.

In another embodiment, the invention is an adjustable ski pole basket having a central stationary member with an aperture configured to accept a ski pole. The central stationary member may have an approximately circular shape, or may have some other shape. The aperture is configured to accept at least a portion of the ski pole. The aperture provides communication between the base and handle-facing side of the central stationary member. Ski poles are generally tapered so that the portion of the ski pole closest to the handle has a larger diameter than the portion of the ski pole closest to a ski pole tip. Some ski poles have a ring positioned near a tip of the ski pole. Baskets can also be secured to the ski pole with an adhesive. Because of the variation in ski pole diameters and the optional presence of a ring, one embodiment of the invention is an attachment configured to be accepted by the aperture and further configured to accept a ski pole and/or engage a ski pole ring. Thus, the aperture can be configured to accept a ski pole having a large diameter. With the attachment, the adjustable ski pole basket can be attached to ski poles having a smaller diameter, or ski poles that do not have a ring.

The adjustable ski pole basket is secured to the ski pole by any means known to one of ordinary skill in the art. For example, the adjustable ski pole basket can be secured to the ring on the ski pole, or adhered to the ski pole with an adhesive. One of ordinary skill would recognize other means of attaching the adjustable ski pole basket to a ski pole.

In one embodiment, the adjustable ski pole basket has at least one petal. Other embodiments of the adjustable ski pole basket have at least two, at least three, or at least four petals. Each petal is connected to the central stationary member by a connecting member.

In one embodiment, the petal is connected to a handle-facing side or top of the central stationary member. The central stationary member has a base that is substantially perpendicular to a shaft of the ski pole. The base is the portion of the central stationary member that contacts the snow or ground during operation. Thus, it is also substantially parallel to the ground.

The length of the petal can vary based on the position where it is fixed to the central stationary member. However, the petal should have a length sufficient to provide adequate buoyancy in powder conditions when in the expanded position. The petal provides a footprint, which is greater than the fixed footprint provided by the central stationary member. The footprint is measured between two points furthest from the center of the base along an imaginary straight line that passes through the center of the base.

The petal can have various shapes. In one embodiment, a bottom portion of the petal is substantially flat. In another embodiment, the bottom portion of the petal is curved towards a handle side of the ski pole when the petal is in the expanded position.

The connecting member extends through at least a portion of the central stationary member and at least a portion of the petal. In one embodiment, the connecting member extends through at least a portion of the petal at a pivot point. The connecting member permits the petal to rotate about the pivot point.

In one embodiment, the pivot point allows the petal to rotate on a plane. The plane is at an angle relative to the plane of the base of the central stationary member. Due to the angle, the petal can be rotated around the pivot point to a compact position, wherein an outside tip of the petal is in close proximity to the ski pole.

The petal includes a catch extending from an interior surface of the petal. The catch is configured to engage a resilient latch positioned on a latch hub when the latch hub is in a first position or upward position. In embodiments with multiple petals, each petal has a corresponding catch, and each catch has a corresponding resilient latch.

In one embodiment, the latch hub is connected to the central stationary member by a guide. The guide extends from the central stationary member through a guide aperture in the latch hub. In this embodiment, the latch hub is biased to a first position or upward position by a latch hub biasing member, such as a compression spring. In another embodiment, the adjustable ski pole basket includes a second guide extending from the central stationary member through a second guide aperture in the latch hub. In another embodiment, the adjustable ski pole basket includes a third guide extending from the central stationary member through a third guide aperture in the latch hub. Other embodiments include additional guides and apertures in the latch hub.

The guide aperture extends through at least a portion of the latch hub from a bottom portion of the latch hub. In certain embodiments, the guide aperture extends through the latch hub and provides communication between the tip-end side of the latch hub and a handle-side of the latch hub.

The latch hub slidably engages the ski pole and is positioned on a handle side of the ski pole relative to the central stationary member. The latch hub is biased toward a first position or upward position relative to the central stationary member. In the first position, the latch hub positions the resilient latch to co-act with the catch. Thus, when the latch hub is in the first position and the petal is in the compact position, the resilient latch prevents the petal from rotating to the expanded position by contacting the catch and holding the catch and the petal in the compact position.

The petal is biased to the expanded position by a biasing member. In one embodiment, the biasing member is associated with the connecting member. In another embodiment, the biasing member is a spring.

Certain embodiments include an actuator. The actuator slidably engages the ski pole. It is positioned on the handle side of the ski pole relative to the latch hub. The actuator can act on a handle-side portion of the latch hub thereby moving the latch hub to a second position or downward position. In the second position, the catch releases from the resilient latch. Once released, the petal, which is biased toward the expanded position, rotates to the expanded position about the pivot point.

In other embodiments, the actuator is not required. The top of the latch hub extends along the ski pole to a position sufficient to allow an operator to push on the top of the latch hub, thereby moving the latch hub to the second position.

In one embodiment, the adjustable ski pole basket includes a stop. The stop is associated with the petal and prevents the petal from rotating in a direction around the pivot point beyond the expanded position.

Another embodiment of the invention is a method of retrofitting a ski pole with an embodiment of the adjustable ski pole basket described above. The adjustable ski pole basket can be affixed to the ski pole by means known to one within the art. In one embodiment, the method of retrofitting a ski pole with the adjustable ski pole basket includes providing the ski pole. The ski pole includes an elongated member. In one embodiment, an embodiment of the adjustable ski pole basket described above is attached to a ring member on the ski pole. In another embodiment, the method of retrofitting further includes removing an existing basket. In another embodiment, the adjustable ski pole basket is adhered to the ski pole by an adhesive. The adhesive can be any adhesive within the art to adhere baskets to ski poles. In another embodiment, an attachment is inserted into the aperture on the central stationary member to allow the aperture to accept and be secured to the ski pole.

Another embodiment of the invention is a method of converting a basket for groomed conditions to a basket for powder conditions. This method includes rotating a petal from a compact position to an expanded position. In one embodiment, this method further includes releasing a catch extending from a petal from a resilient latch positioned above a ski pole basket. The petal is rotated about a pivot point until the petal reaches the extended position.

It is therefore an object of the present invention to provide a ski pole designed to selectively produce a basket with an increased radius for increased floatation while the skier is skiing.

A further object of the present invention is to provide a ski pole including a first basket fixed in position and having a fixed radius and an expandable second basket having a radius that is greater than that of the first basket.

These and other objects and advantages of the invention will be made apparent from the following description taken together with the drawings.

DETAILED DESCRIPTION OF THE INVENTION

Figure 1:
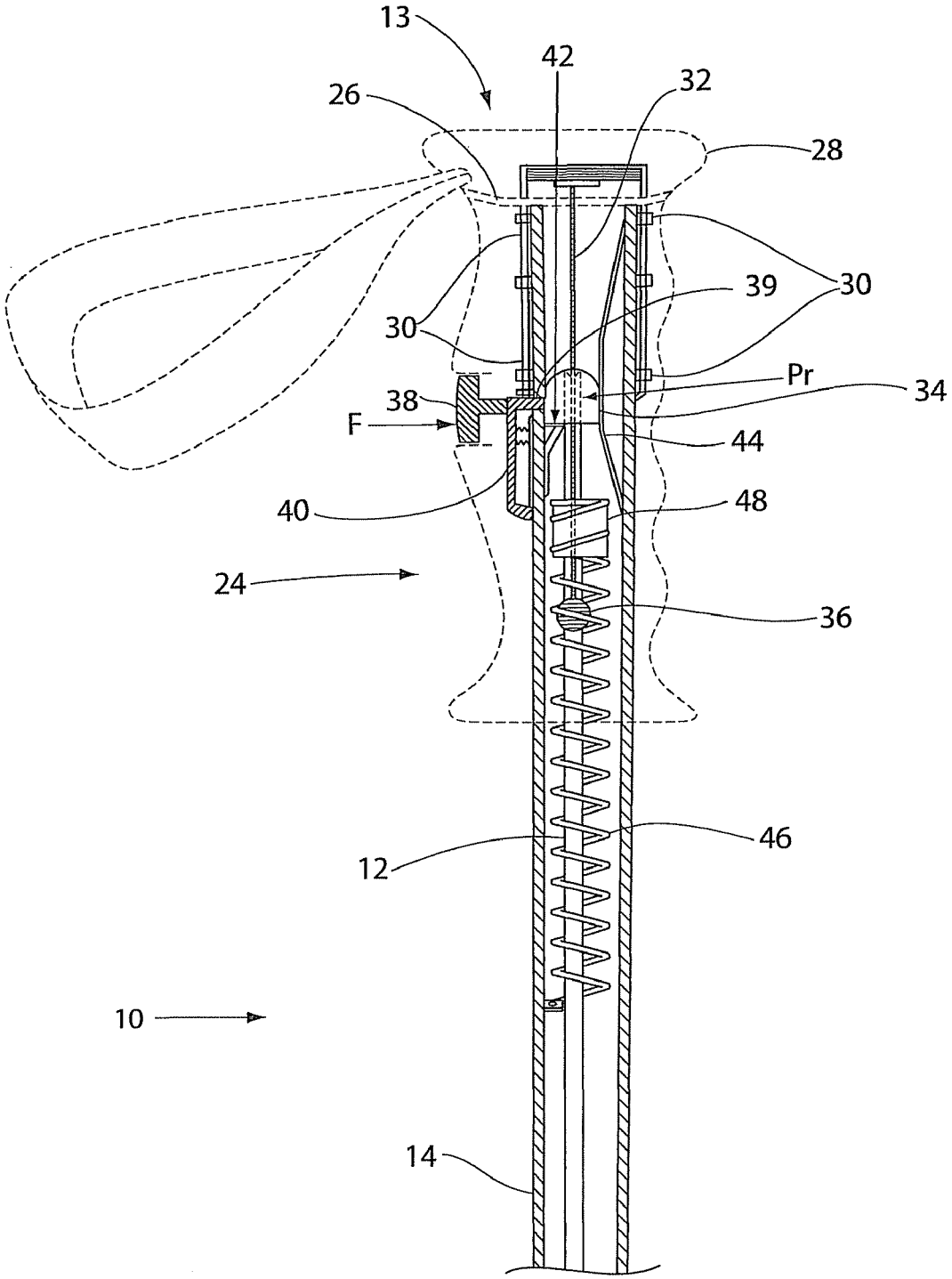
FIG. 1 is an elevational cross-section view of an upper part of a ski pole of the invention illustrating a mechanism for operating an expandable basket arrangement.

FIG. 1 shows an upper part of a ski pole 10 having a hollow shaft 14 and a ski pole grip 24. An actuator 38 extends through the ski pole grip 24 towards the hollow shaft 14. The hollow shaft 14 houses a kinetic rod 12. The kinetic rod 12 is biased towards a first position or a downward position relative to the ski pole grip 24 by a biasing member 46. The kinetic rod 12 has a barrel capsule 48 positioned on a ski pole grip end of the kinetic rod 12. The biasing member 46 is connected to the barrel capsule 48. The kinetic rod 12 is held in a second position or an upward position relative to the tip 15 of the ski pole 10 by a ledge 42. The ledge 42 is formed in hollow shaft 14 of ski pole 10, and is positioned below the actuator 38.

The ski pole grip 24 includes a removable cap 28 positioned on a first end or top 26 of the ski pole grip 24. The removable cap 28 can be detached from the ski pole grip 24, and can be moved away from the ski pole grip 24 following a guide attachment 30, which is positioned within the hollow shaft 14 of ski pole 10. The guide attachment 30 acts as a brace to guide the movement of the removable cap 28 in a direction parallel to the hollow shaft 14.

A pull rod 32 is attached to the removable cap 28 and positioned within hollow shaft 14. The pull rod 32 also extends through a stop capsule 34 and can be connected to the kinetic rod 12 or can pass through or over the barrel capsule 48. A catch ball 36 is positioned within the hollow shaft 14 on a tip 15 end of the pull rod 32. The catch ball 36 has a width large enough to prevent it from passing past the barrel capsule 48. The stop capsule 34 is positioned between the kinetic rod 12 and the removable cap 28 within the hollow shaft 14. When the kinetic rod 12 is in the second position or upward position, the stop capsule 34 abuts the ledge 42.

The ski pole 10 also includes a spring hammer 40 positioned between the ski pole grip 24 and the hollow shaft 14 in communication with the actuator 38 and the stop capsule 34. The hollow shaft 14 has an orifice 56 configured to allow passage of a portion of the spring hammer 40 therethrough when force F is applied to the actuator 38.

A retention band 44 is positioned within hollow shaft 14 and provides constant pressure Pr against the stop capsule 34 when the kinetic rod 12 is in the second position or upward position, wherein the stop capsule 34 is moved and/or retained against the ledge 42 by the retention band 44 when the kinetic rod 12 is in the second position or upward position.

With particular reference to FIGS. 1-4, the kinetic rod 12 is connected a basket coupler 18 by a connector-pin 16. The basket coupler 18 is also connected to a petal 20. The basket coupler 18 and petal 20 in the expanded positions are shown in phantom in FIG. 2.

Figure 3:
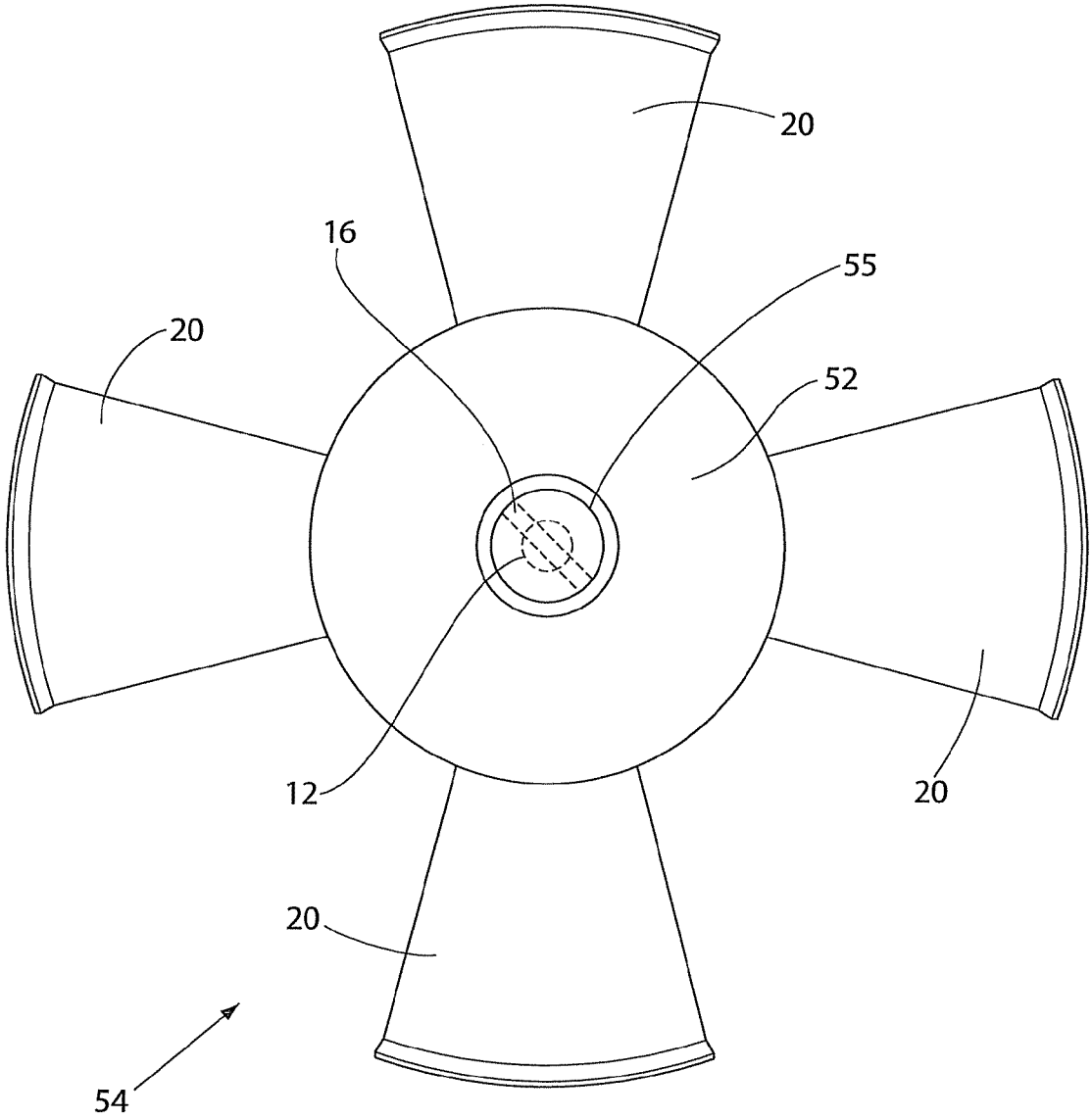
FIG. 3 is a bottom view showing a ski pole having an adjustable ski pole basket with petals in an expanded position.
Figure 4:
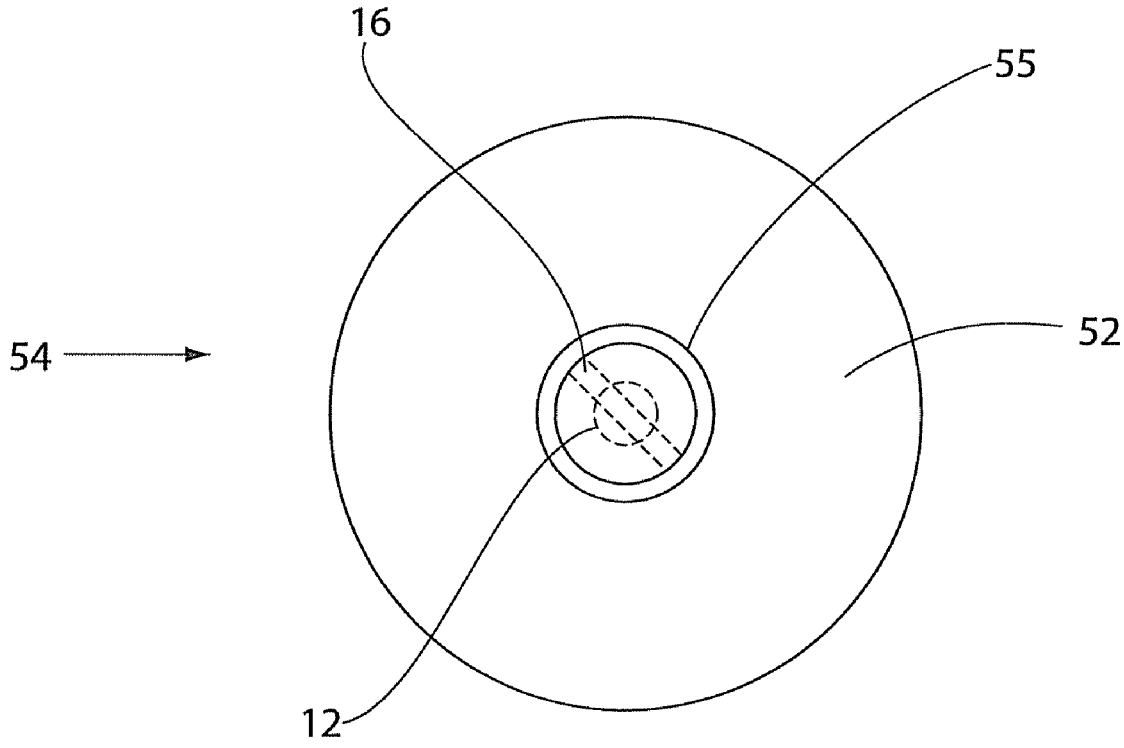
FIG. 4 is a bottom view showing a ski pole having an adjustable ski pole basket with petals in a compact position.

As particularly shown in FIG. 4, the connector pin 16 also connects the kinetic rod 12 to the basket coupler 18 (FIG. 2) via two channels 22 (FIG. 2) in the hollow shaft 14 of ski pole 10. The basket coupler 18 is positioned outside the hollow shaft 14. The connector pin 16 is positioned within the hollow shaft 14. The channels 22 provide passage for the connector pin 16 to connect to the basket coupler 18. They further enable the kinetic rod 12 via the connector pin 16 to move the basket coupler 18 (FIG. 2) and petals 20 (FIG. 3) from the compact position to the expanded position, as shown in phantom in FIG. 3. It also allows for the kinetic rod 12 to pull the basket coupler 18 (FIG. 2) and the petals 20 from the expanded position as shown in phantom in FIG. 2 to the compact position as shown in FIGS. 2 and 4.

Figure 2:
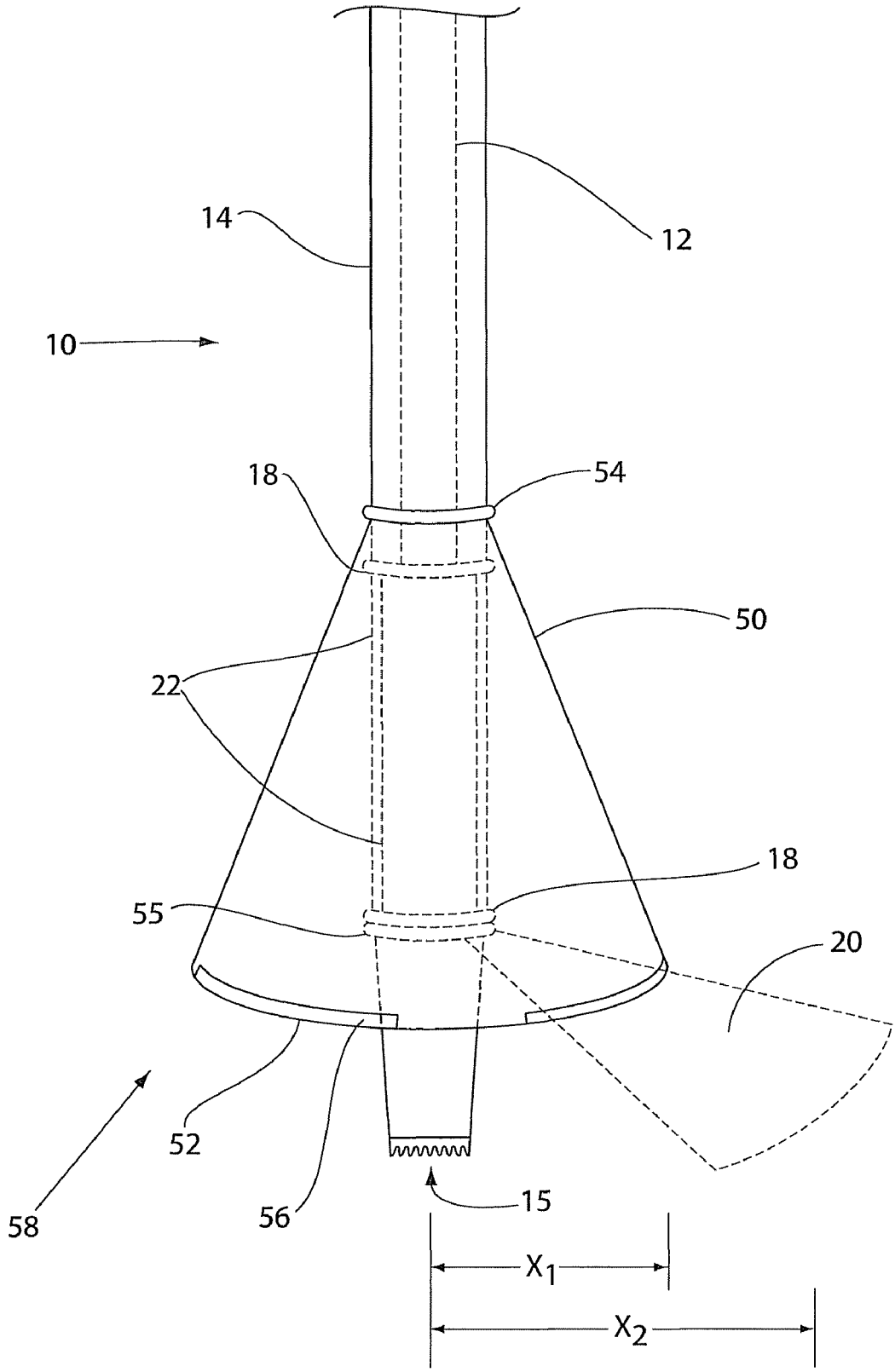
FIG. 2 is an elevational cross-section view of a lower part of the ski pole of FIG. 1, illustrating a cone-basket combination and a petal in an expanded position in phantom.

In FIG. 2, an outer protective cone 50 covers the basket coupler 18 and petals 20, so to prevent snow and/or ice from collecting therein, which could inhibit movement of the petals 20. The protective cone 50 is connected to a fixed basket 52. Protective cone 50 is connected to hollow shaft 14 via two coupler mounting rings 54, 55 mounted on a tip 15 facing side and a ski pole grip 24 facing side of the protective cone 50. The widest diameter of protective cone 50 is approximately equal to the diameter or width of the fixed basket 52.

As indicated in FIG. 2, the adjustable ski pole basket 58 has a first footprint and a second footprint. The first footprint is provided by a fixed basket 52 having a fixed radius xi. The fixed radius $x_1$ may be about 1.25 inches (32 mm) to about 1.4 inches (36 mm). The petals 20 provide the adjustable ski pole basket 58 with a second footprint having a second radius $x_2$. The second radius $x_2$ may be about 2.5 inches (64 mm) to about 3.5 inches (89 mm).

FIG. 3 shows petals 20 in the expanded position, wherein petals 20 have passed through orifices 56 located between the fixed basket 52 and the protective cone 50 (FIG. 2). Preferably, petals 20 are flexible yet rigid so that they smoothly pass through orifices 56 during both the expansion of petals 20 outside protective cone 50 and the collapsing of petals 20 within protective cone 50.

Figure 5:
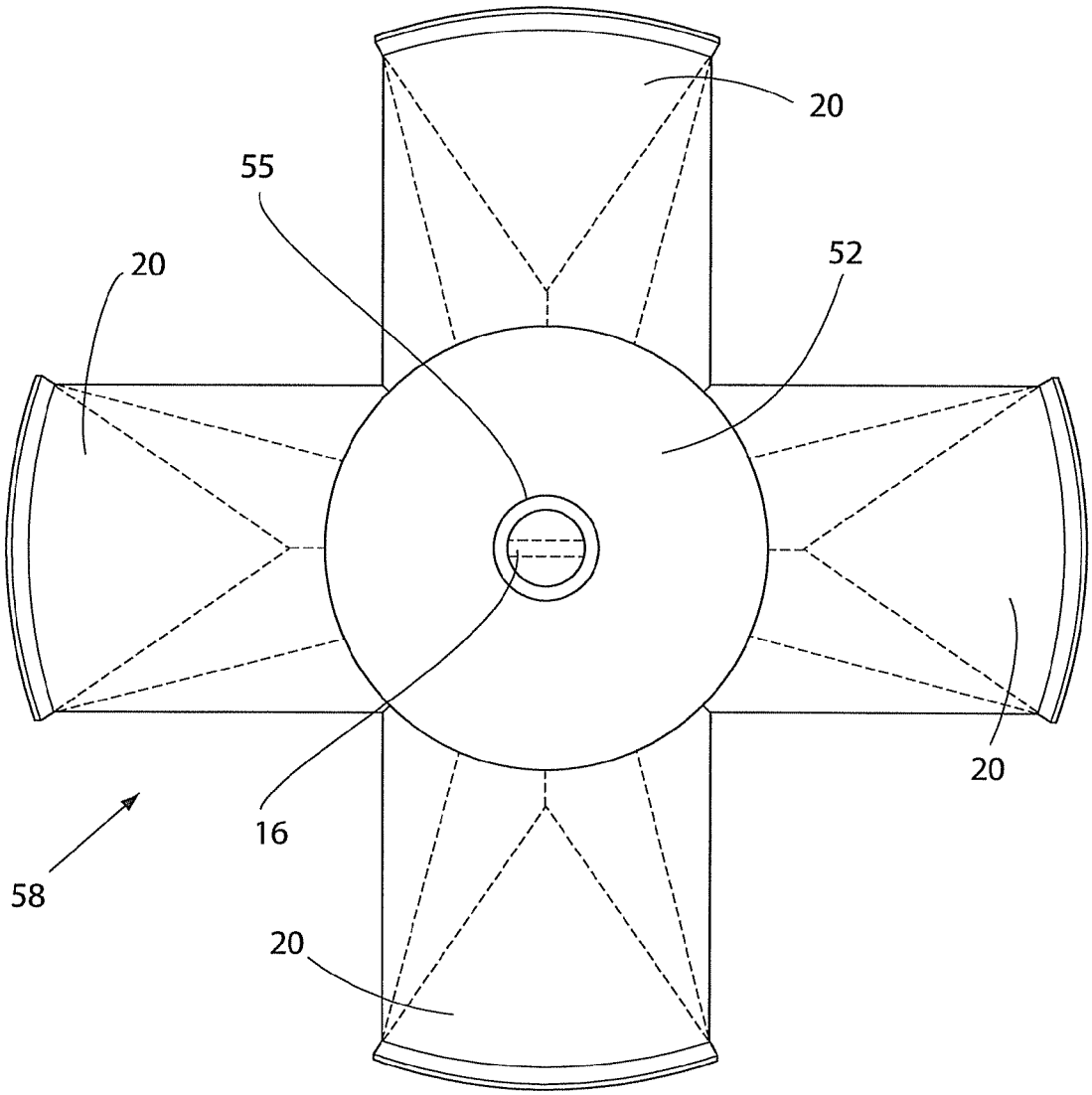
FIG. 5 is a bottom view showing a ski pole having an adjustable ski pole basket with an alternate form of petals in an expanded position.

FIG. 5 shows an alternate profile for the petals 20 in the expanded position according to the invention. Instead of a linear tapered design as illustrated in FIG. 3, the petals 20 shown in FIG. 5 remain at a constant width in the expanded position. At the point where the petal 20 is housed inside the protective cone 50, it folds, narrowing incrementally until it reaches the compact position and is approximately fully within the protective cone 50. These petals 20 have varying leading edge thicknesses to overlap or under-lap themselves and/or adjacent petals as they are retracted into the protective cone 50, so to accommodate the difference in area covered by the petals 20 in the expanded position and the area permitted by the confinements of the protective cone 50 when the petals 20 are in the compact position.

In operation of this embodiment, an operator, such as a skier, will apply force F to the actuator 38. The actuator 38 is a deployment button which can be operated by a skier while skiing. The actuator will transfer that force F to the spring hammer 40. The spring hammer 40 will transfer the force F to the stop capsule 34. The stop capsule 34 will then slide across the ledge 42 while deforming the retention band 44. Once the stop capsule 34 has moved a sufficient distance to disengage it from the ledge 42, the biasing member 46 pulls the kinetic rod 12 towards the first position or downward position. As the biasing member 46 pulls the kinetic rod 12 towards the first position, the basket coupler 18 and petals 20 move from a compact position, as shown in FIGS. 2 and 4, to an expanded position, as shown in FIGS. 3 and 5, and shown in phantom in FIG. 2.

To retract the petals 20 into protective cone 50 and raise the basket coupler 18 and the kinetic rod 12, the removable cap 28 is lifted away from the ski pole grip 24 by the operator. This action will move the stop capsule 34 and the kinetic rod 12 to the second position or upward position relative to the tip 15. At the second position, the retention band 44 applies pressure to the stop capsule 34 to move and retain the stop capsule 34 over the ledge 42 until force F is applied to the actuator 38. Once the stop capsule 34 is positioned over the ledge 42, the petals 20 are approximately fully retracted to the compact position into the protective cone 50, and can be again moved to the expanded position by actuation of the actuator 38. Also, once the stop capsule 34 is positioned over the ledge 42, the removable cap 28 can be returned to the ski pole grip 24, and the interaction between the stop capsule 34 and the ledge 42 will hold the kinetic rod 12 in the second position until force F is applied to the actuator 38.

Figure 6:
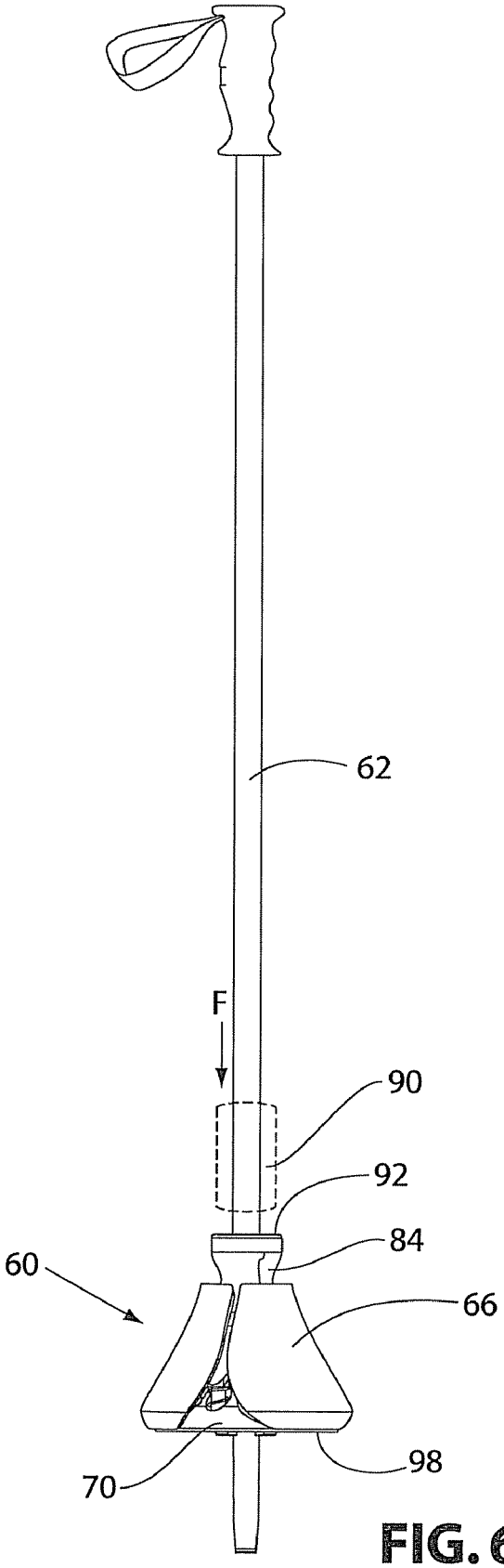
FIG. 6 is a side view of a ski pole having an adjustable ski pole basket in a compact position.
Figure 7:
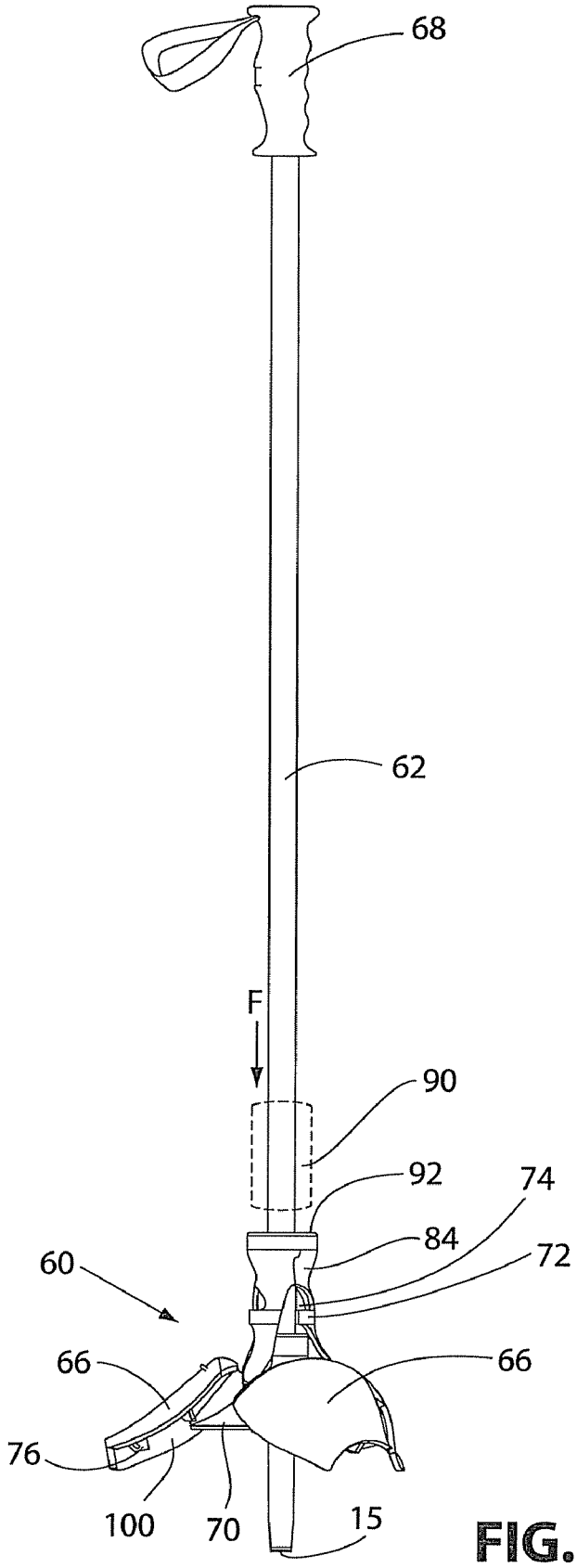
FIG. 7 is a side view of a ski pole having an adjustable ski pole basket in an expanded position.
Figure 8:
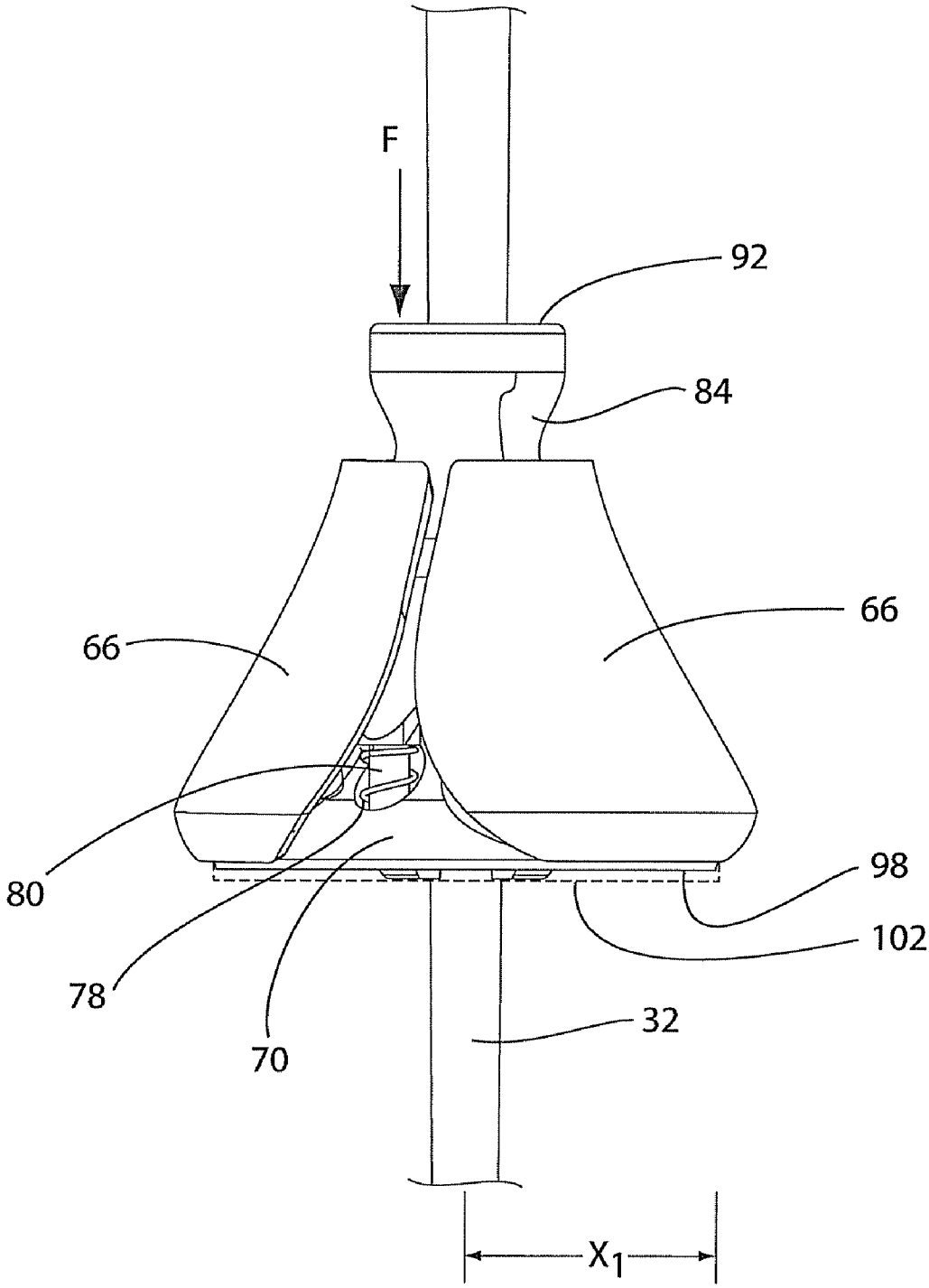
FIG. 8 is a side view of an adjustable ski pole basket positioned on a ski pole in a compact position.
Figure 9:
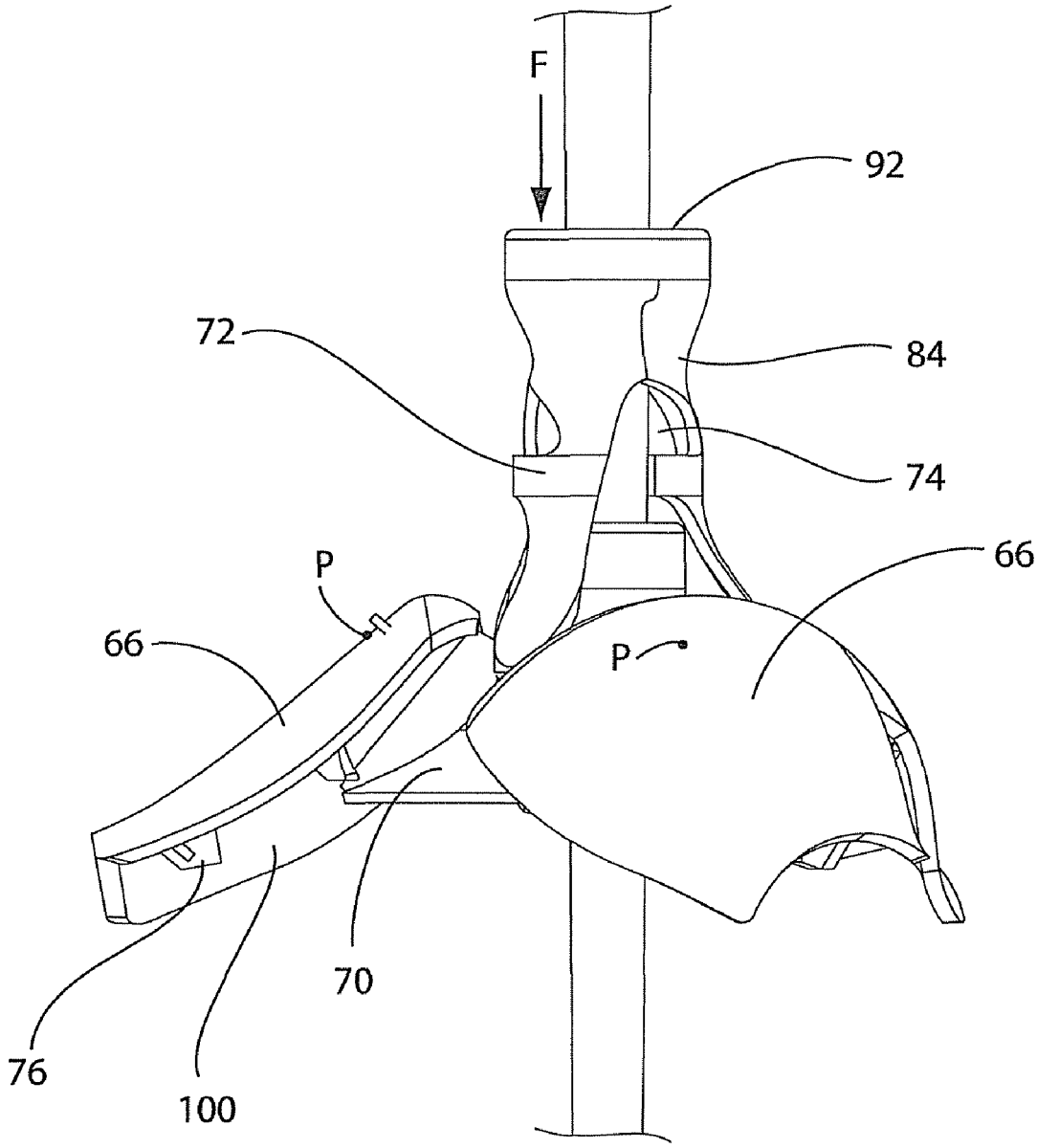
FIG. 9 is a view of an adjustable ski pole basket positioned on a ski pole in an expanded position.
Figure 10:
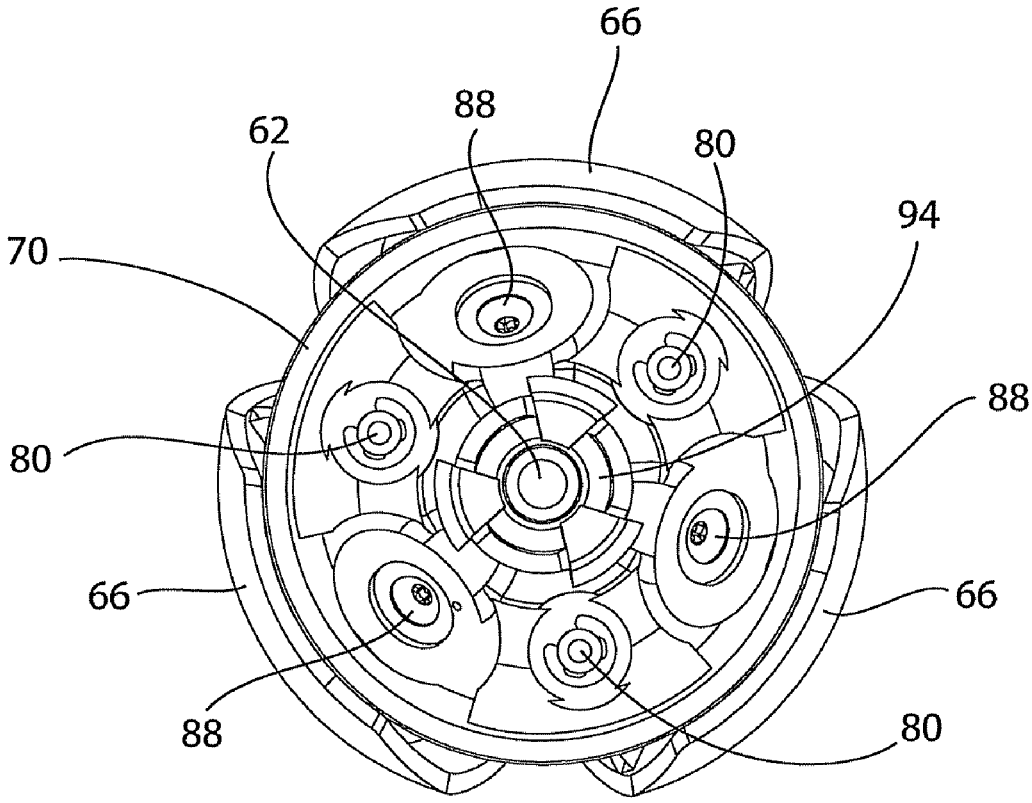
FIG. 10 is a bottom view of an adjustable ski pole basket in a compact position.
Figure 11:
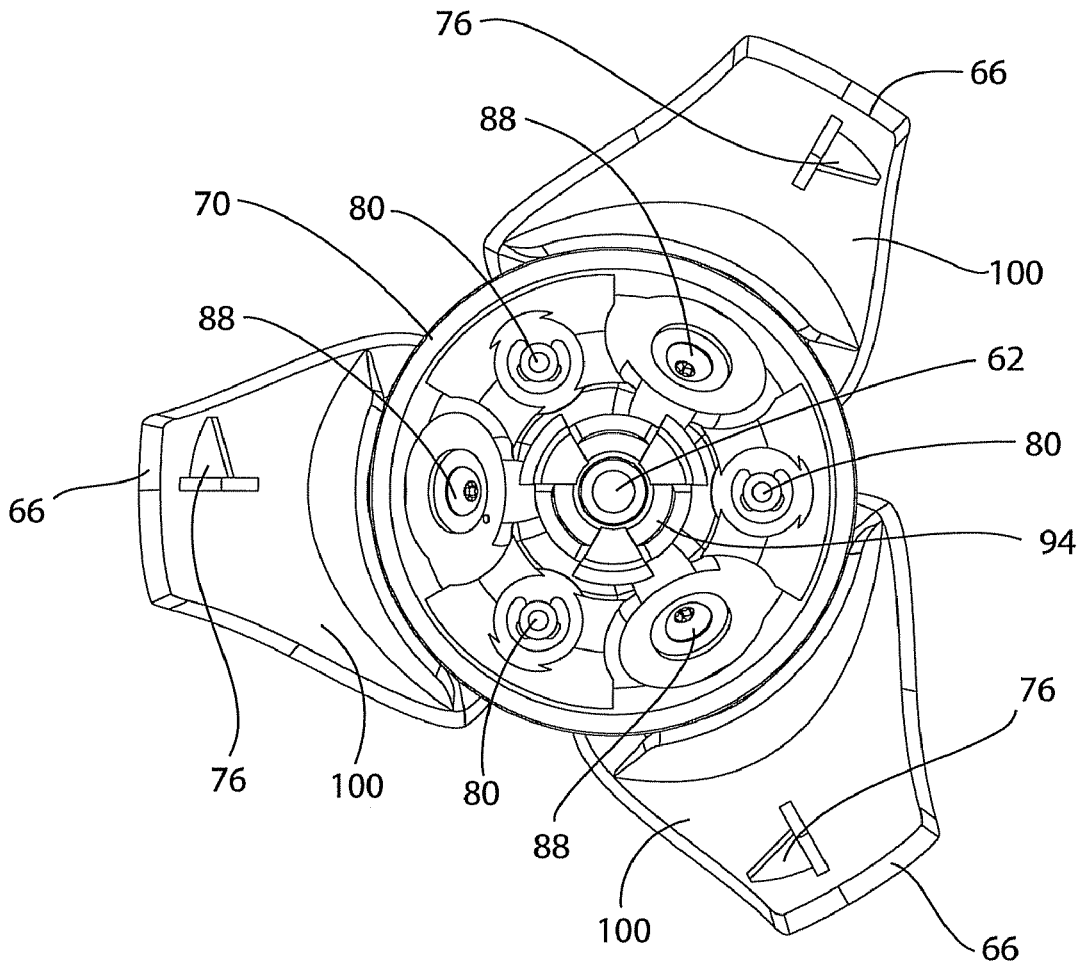
FIG. 11 is a bottom view of an adjustable ski pole basket in an expanded position.

Another embodiment of the invention is illustrated in FIGS. 6-14. In this embodiment, the adjustable ski pole basket 60 has a petal 66. The petal 66 is connected to a handle 68 facing side of a central stationary member 70. Each petal 66 is held in the compact position, as illustrated in FIGS. 6, 8, and 10, by a corresponding resilient latch 72, shown in FIGS. 7, 9, and 12-14.

The resilient latch 72 is part of a latch hub 84. The latch hub 84 is biased to a first position or upward position by a biasing member 78, for example, a compression spring. The biasing member 78 extends from the central stationary member 70 and interacts with the latch hub 84 at or near a tip 15 facing side of the latch hub 84.

To prevent the latch hub 84 from rotating, a guide 80 extends from a central stationary member 70 through a guide aperture 82 in the latch hub 84. The biasing member 78 extends from the central stationary member 70 and interacts with the latch hub 84 at or near the guide aperture 82 for the guide 80 or the tip 15 facing side of the latch hub 84. The biasing member 78 shown in the figures is a compression spring positioned around the guide 80.

The resilient latch 72 has an opening 74 along a circumferential surface of the latch hub 84. The opening 74 is positioned on a handle 68 side of the latch hub 84 relative to the resilient latch 72.

The adjustable ski pole basket 60 is configured to accept a ski pole 62 through at least an aperture extending through the base 98 of the central stationary member 70. Preferably, the aperture also extends through the latch hub 84.

The central stationary member optionally includes a cover 102. The cover 102, shown in phantom in FIG. 11, covers the base 98 of the central stationary member 70 that would be exposed to the ground or snow during operation.

Figure 12:
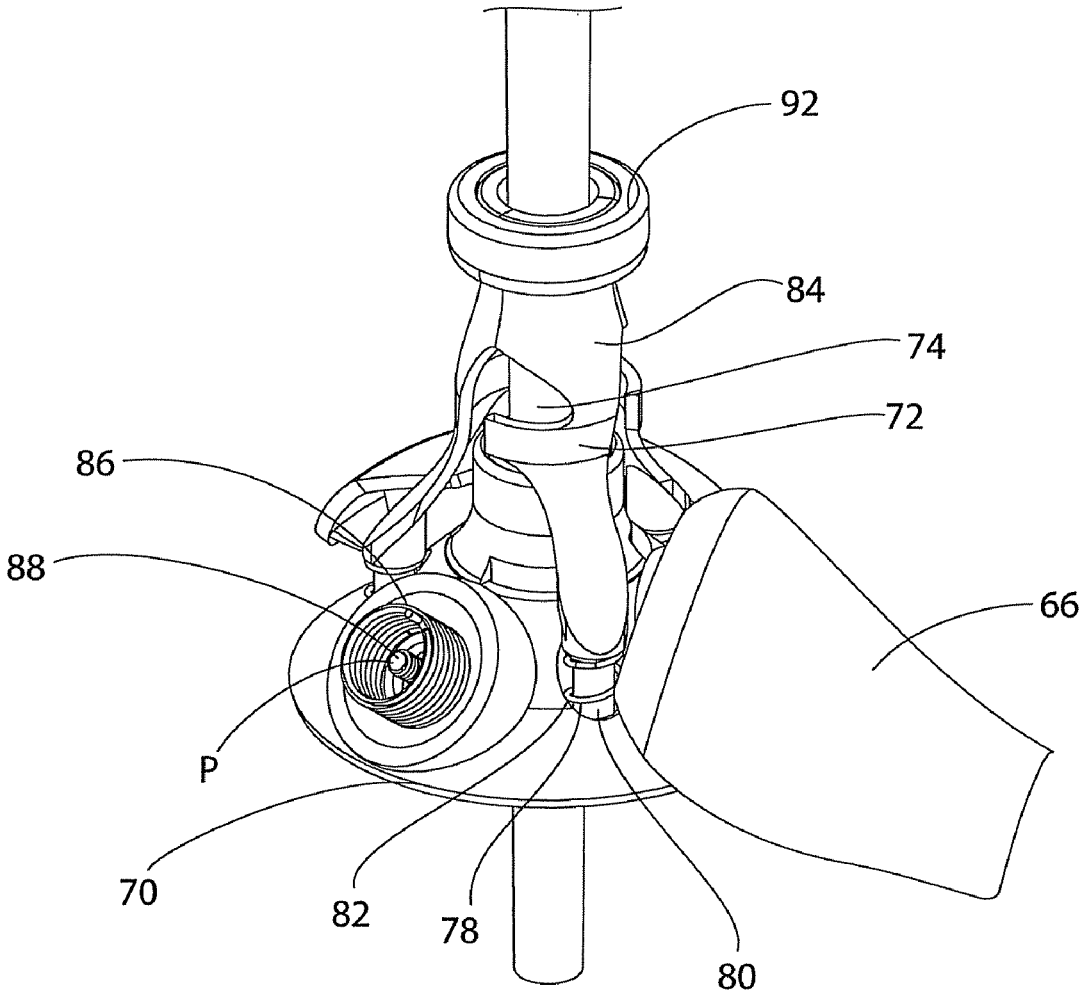
FIG. 12 is a side view of an adjustable ski pole basket positioned in an expanded position with one of the petals removed from a connecting member.
Figure 13:
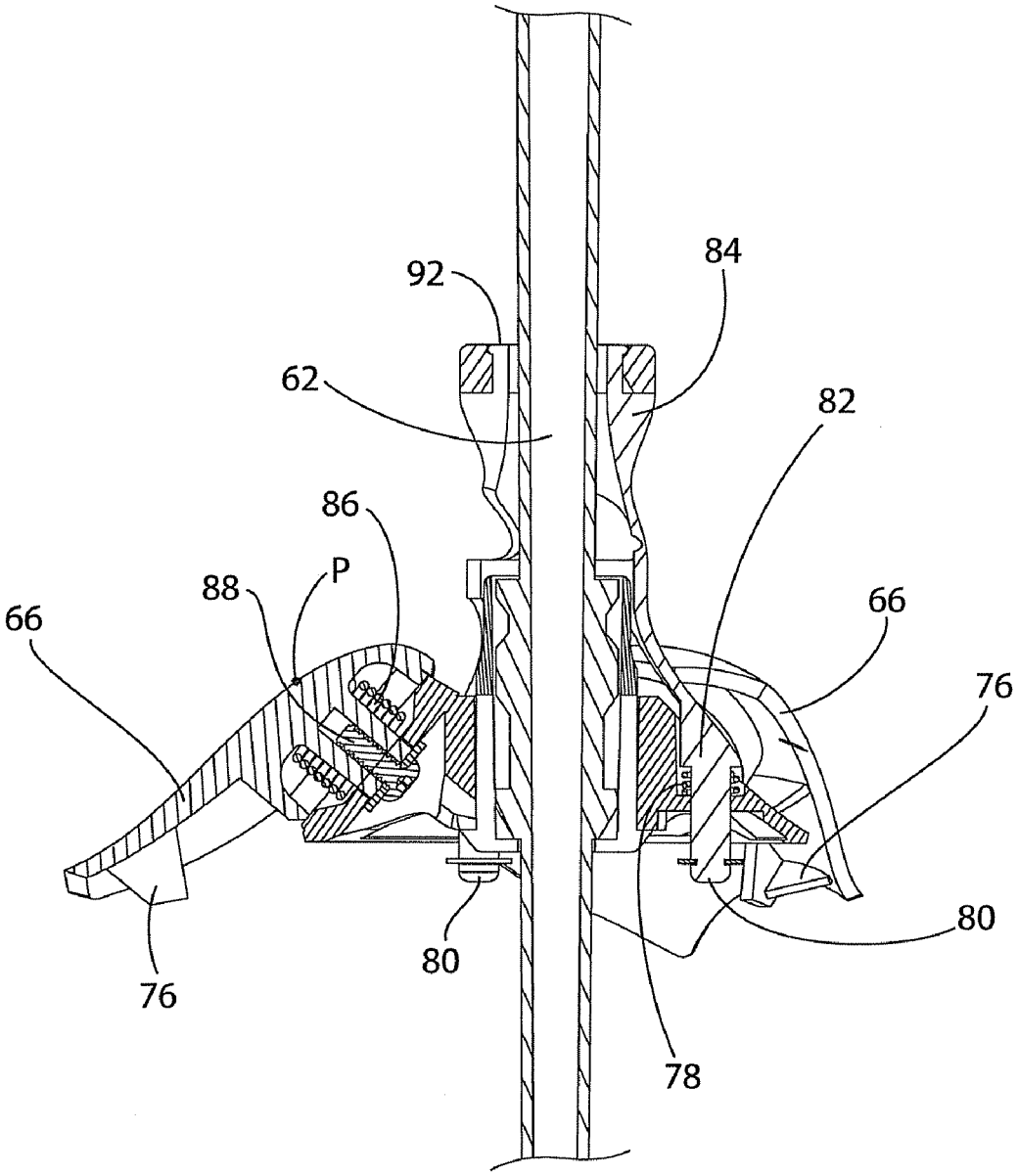
FIG. 13 is a cross-sectional view of an adjustable ski pole basket positioned on a ski pole in an expanded position.
Figure 14:
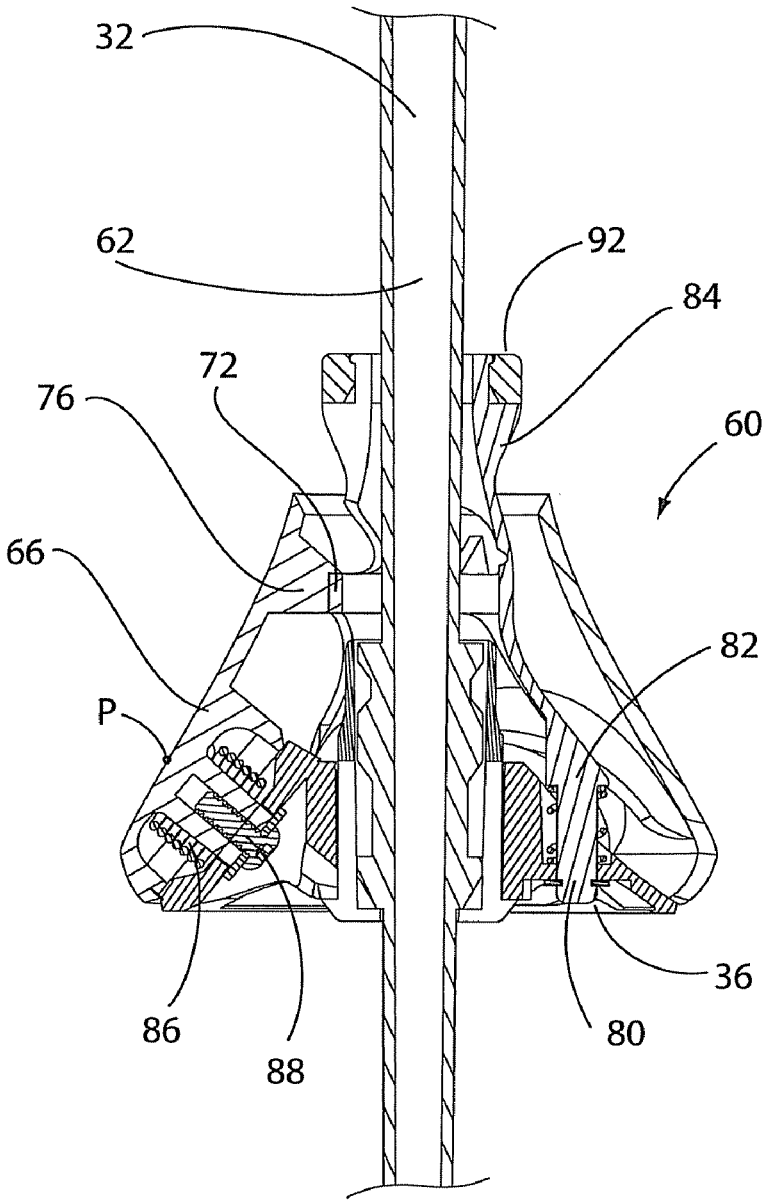
FIG. 14 is a cross-sectional view of an adjustable ski pole basket positioned on a ski pole in a compact position.

The connecting member 88 that connects the petal 66 to the central stationary member 70 is show in FIG. 12. To illustrate the connecting member 88, a petal 66 has been removed in the illustration of the adjustable ski pole basket 60 in FIG. 12. The connecting member 88 extends from the central stationary member 70 to a pivot point P on the petal 66.

The petal 66 is biased to the expanded position by a biasing member 86 such as a torsion spring. To illustrate the biasing member 86, a petal 66 has been removed in the illustration of the adjustable ski pole basket 60 in FIG. 12. The biasing member 86 is a spring associated with the connecting member 88. The biasing member 86 biases the petal 66 to rotate around the pivot point P to the expanded position.

In operation, an operator will apply force F on the handle-side portion 92 of the latch hub 84 or on the optional actuator 90, which will transfer the force F to the handle-side portion 92 of the latch hub 84. The force F can be applied by the operator's hand, or by sliding a second ski pole along the shaft of the ski pole 62 until contact is made with the handle-side portion 92 of the latch hub 84 or the actuator 90. As a result of the force F, the latch hub 84 moves to a second position or downward position and compresses the biasing member 78. The catch 76 that extends from the interior side 100 of the petal 66 releases from the resilient latch 72 by virtue of the latch hub 84 and resilient latch 72 moving towards the tip 15. The catch 76 passes through at least a portion of the opening 74 in the latch hub 84. By action of the biasing member 86, the petal 66 rotates about the pivot point P to the expanded position. In the expanded position, the petals 66 provide a footprint $x_2$ that is larger than the fixed footprint $x_1$ provided by the central stationary member 70 (see FIGS. 8 and 9).

From the expanded position, the petal 66 can be returned to the compact position by manually rotating the petal 66 about the pivot point P until the catch 76 comes into contact with the resilient latch 72 and holds the petal 66 from rotating. Since the latch hub 84 is biased to the first position or upward position, without force F being applied to the handle-side portion 92 of the latch hub 84, the resilient latch 72 is in a position to accept the catch 76 once the petal 66 is rotated to the compact position. As the catch 76 passes over the resilient latch 72 while the petal 66 is being rotated from the expanded position to the compact position, the resilient latch 72 bends to accommodate the catch 76. Once the petal 66 reaches the compact position, the resilient latch 72 is returned to its normal form and acts on the catch 76 and prevents the petal 66 from rotating.

In another embodiment, the invention is a method of retrofitting a ski pole 62 with an adjustable ski pole basket 60. The method includes attaching the adjustable ski pole basket 60 to a ski pole 62. The ski pole 62 may have a ski pole ring 94 for attaching baskets. In such embodiments, the adjustable ski pole basket 60 is attached to the ski pole ring 94. If the ski pole 62 does not have a ski pole ring 94, or if the ski pole ring 94 is not suitable for retrofitting the adjustable ski pole basket 60, the adjustable ski pole basket 60 can be adhered to the ski pole 62 by an adhesive.

In another embodiment, the invention is a method of converting a basket for groomed conditions to a basket for powder conditions. The method includes rotating a petal 66 configured to rotate about a pivot point P on a central stationary member 70 from a compact position to an expanded position. The petal 66 is stopped at the expanded position.

The advantages of the present invention include, without limitation, that it is instantly adjustable to changing snow conditions. It is easy to adjust the basket because of the unique basket design and mechanism which allows for adjustment while the skier is in motion. Further, the basket can be expanded from minimum radius to maximum radius instantaneously and simultaneously as to both right and left ski poles.

In a broad embodiment, the present invention relates to an adjustable ski pole basket with an internal mechanism that provides instant expansion of the basket radius, and very quick retraction of the basket radius. The design of the invention allows the device to be integrated into a standard ski pole design.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A ski pole comprising an adjustable basket configured to fit around the ski pole, the adjustable basket comprising:

a central stationary member having an aperture extending therethrough configured to accept the ski pole, a petal connected to a handle facing side portion of the central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to the expanded position, wherein the biasing member is associated with the connecting member, a catch extending from an interior surface of the petal, a latch hub slidably engaging the ski pole positioned on a handle side of the ski pole relative to the central stationary member, and biased toward a first position, said latch hub slidably movable along said ski pole between a first position and a second position, and a resilient latch positioned on the latch hub and configured to accept the catch when the petal is in the compact position and the latch hub is in the first position and wherein movement of the latch hub to the second position releases the catch from the resilient latch and allows the petal to move to the expanded position.

2. The ski pole of claim 1 further comprising an actuator slidably engaging the ski pole positioned on the handle side of the ski pole relative to the latch hub, whereby the actuator is positioned to act on the latch hub thereby moving the latch hub to the second position.

3. The ski pole of claim 1, wherein the biasing member is a spring.

4. The ski pole of claim 1 further comprising a compression spring to bias the latch hub in the first position.

5. The ski pole of claim 1 further comprising a latch guide extending substantially upward from the central stationary member and slidably engaging a guide aperture positioned on the latch hub.

6. An adjustable ski pole basket comprising:

a central stationary member, a petal connected to a first side of the central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to an expanded position, wherein the biasing member is associated with the connecting member, a catch extending from an interior surface of the petal, a latch hub associated with the first portion of the central stationary member and biased toward a first position, said latch hub slidably movable along said ski pole between a first position and a second position, and a resilient latch positioned on the latch hub and configured to accept the catch when the petal is in the compact position and the latch hub is in the first position and wherein movement of the latch hub to the second position releases the catch from the resilient latch and allows the petal to move to the expanded position.

7. The adjustable ski pole basket of claim 6, wherein the biasing member is a spring.

8. The adjustable ski pole basket of claim 6, wherein the latch hub is biased to the first position by a compression spring.

9. The adjustable ski pole basket of claim 6 further comprising a latch guide extending from the first side of the central stationary member and slidably engaging a guide aperture positioned on the latch hub.

10. The adjustable ski pole basket of claim 6 further comprising an aperture extending through the central stationary member configured to engage a ski pole.

11. The adjustable ski pole basket of claim 6 further comprising an actuator configured to act on the latch hub when actuated thereby moving the latch hub to the second position.

12. A method of retrofitting a ski pole with an adjustable ski pole basket comprising:

providing a ski pole including an elongated member, attaching an adjustable ski pole basket to an end portion of the ski pole, wherein the adjustable ski pole basket comprises:

a central stationary member having an aperture configured to accept the ring member on the ski pole, a petal connected to a handle facing side of the central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to an expanded position, wherein the biasing member is associated with the connecting member, a catch extending from an interior surface of the petal, a latch hub associated with a top portion of the central stationary member and biased toward a first position, said latch hub slidably movable along said ski pole between the first position and a second position, and a resilient latch positioned on the latch hub and configured to accept the catch when the petal is in the compact position and the latch hub is in the first position and wherein movement of the latch hub to the second position releases the catch from the resilient latch and allows the petal to move to the expanded position.

13. The method of claim 12 further comprising attaching an actuator configured to act on the latch hub when actuated thereby moving the latch hub to the second position.

14. The method of claim 12, wherein the biasing member is a spring.

15. The method of claim 12, wherein the latch hub is biased to the first position by a compression spring.

16. The method of claim 12, wherein the adjustable ski pole basket further comprises a latch guide extending from the handle facing side of the central stationary member and slidably engaging a guide aperture positioned on the latch hub.

17. A ski pole comprising an adjustable basket configured to fit around the ski pole, the adjustable basket comprising:

a central stationary member having an aperture extending therethrough configured to accept the ski pole, a petal connected to a handle facing side portion of the central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to the expanded position, wherein the biasing member is associated with the connecting member, a catch extending from an interior surface of the petal, a latch hub slidably engaging the ski pole positioned on a handle side of the ski pole relative to the central stationary member, and biased toward a first position, a resilient latch positioned on the latch hub and configured to accept the catch when the petal is in the compact position and the latch hub is in the first position, and a compression spring to bias the latch hub in the first position.

18. An adjustable ski pole basket comprising:

a central stationary member, a petal connected to a first side of the central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to an expanded position, wherein the biasing member is associated with the connecting member, a catch extending from an interior surface of the petal, a latch hub associated with the first portion of the central stationary member and biased toward a first position, a resilient latch positioned on the latch hub and configured to accept the catch when the petal is in the compact position and the latch hub is in the first position, and a latch guide extending from the first side of the central stationary member and slidably engaging a guide aperture positioned on the latch hub.

19. A method of retrofitting a ski pole with an adjustable ski pole basket comprising:

providing a ski pole including an elongated member, attaching an adjustable ski pole basket to an end portion of the ski pole, wherein the adjustable ski pole basket comprises:

a central stationary member having an aperture configured to accept the ring member on the ski pole, a petal connected to a handle facing the side of central stationary member by a connecting member, wherein the petal is biased to rotate about a pivot point on the central stationary member from a compact position to an expanded position and wherein the connecting member extends through at least a portion of the central stationary member and at least a portion of the petal, a biasing member for biasing the petal to an expanded position, wherein the biasing member is associated with the connecting member, a catch extending from an interior surface of the petal, a latch hub associated with a top portion of the central stationary member and biased toward a first position, the latch hub being biased to the first position by a compression spring, and a resilient latch positioned on the latch hub and configured to accept the catch when the petal is in the compact position and the latch hub is in the first position.

* * * * *